US008269677B2

(12) United States Patent
Guterman et al.

(10) Patent No.: US 8,269,677 B2
(45) Date of Patent: Sep. 18, 2012

(54) DUAL-BAND CAVITY-BACKED ANTENNA FOR INTEGRATED DESKTOP COMPUTER

(75) Inventors: Jerzy Guterman, Mountain View, CA (US); Eduardo Lopez Camacho, Watsonville, CA (US); Mattia Pascolini, Campbell, CA (US); Enrique Ayala Vazquez, Watsonville, CA (US); Robert W. Schlub, Campbell, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 491 days.

(21) Appl. No.: 12/553,943

(22) Filed: Sep. 3, 2009

(65) Prior Publication Data

US 2011/0050508 A1 Mar. 3, 2011

(51) Int. Cl.
*H01Q 1/24* (2006.01)
*H01Q 1/42* (2006.01)

(52) U.S. Cl. ..... 343/702; 343/789

(58) Field of Classification Search ..... 343/702, 343/789

See application file for complete search history.

(56) References Cited

U.S. PATENT DOCUMENTS

| | | | | |
|---|---|---|---|---|
| 4,733,245 | A | 3/1988 | Mussler | |
| 5,008,681 | A * | 4/1991 | Cavallaro et al. | 343/700 MS |
| 6,081,729 | A | 6/2000 | Bauerschmidt et al. | |
| 6,225,959 | B1 | 5/2001 | Gordon | |
| 6,339,400 | B1 | 1/2002 | Flint et al. | |
| 6,380,930 | B1 | 4/2002 | Van Ruymbeke | |
| 6,686,886 | B2 | 2/2004 | Flint et al. | |
| 6,853,336 | B2 | 2/2005 | Asano et al. | |
| 6,894,650 | B2 | 5/2005 | Darden et al. | |
| 6,950,069 | B2 | 9/2005 | Gaucher et al. | |
| 2004/0227679 | A1 * | 11/2004 | Lu | 343/702 |
| 2009/0153412 | A1 | 6/2009 | Chiang et al. | |
| 2010/0103612 | A1 * | 4/2010 | Weber et al. | 361/679.56 |

OTHER PUBLICATIONS

Vazquez et al., U.S. Appl. No. 12/238,384, filed Sep. 25, 2008.
Chiang et al., U.S. Appl. No. 12/401,599, filed Mar. 10, 2009.
Vazquez et al., U.S. Appl. No. 12/486,496, filed Jun. 17, 2009.
Chiang et al., U.S. Appl. No. 12/104,359, filed Mar. 16, 2008.
Vazquez et al., U.S. Appl. No. 12/553,944, filed Sep. 3, 2009.
Chiang, U.S. Appl. No. 12/356,496, filed Jan. 20, 2009.
Bevelacqua et al., U.S. Appl. No. 12/750,661, filed Mar. 30, 2010.
Shiu et al., U.S. Appl. No. 12/750,660, filed Mar. 30, 2010.
Chiang et al., U.S. Appl. No. 12/500,570, filed Jul. 9, 2009.

* cited by examiner

*Primary Examiner* — Hoang V Nguyen
(74) *Attorney, Agent, or Firm* — Treyz Law Group; G. Victor Treyz; David C. Kellogg

(57) ABSTRACT

An electronic device may have a housing with conductive housing walls. A dielectric antenna window may be formed in an opening in one of the conductive housing walls. A dielectric logo may form the dielectric antenna window. A dielectric support structure may have an outline that matches the dielectric logo. An antenna resonating element for an antenna may be formed on the dielectric support structure. An antenna cavity for the antenna may be formed by a conductive cavity structure. A pattern of voids in the dielectric support structure may reduce dielectric loading for the antenna. The conductive cavity structure may be formed from solderable plated metal. The conductive cavity structure may have a planar lip that is attached to the conductive housing walls using conductive adhesive. Rear wall portions of the conductive cavity structure may be oriented at a non-perpendicular non-zero angle with respect to the planar lip.

29 Claims, 14 Drawing Sheets

DUAL-BAND CAVITY-BACKED ANTENNA FOR INTEGRATED DESKTOP COMPUTER

BACKGROUND

This relates generally to electronic device antennas, and, more particularly, to antennas for electronic devices with conductive housings.

Electronic devices such as computers and communications devices are often provided with wireless communications capabilities. For example, electronic devices may use long-range wireless communications circuitry such as cellular telephone circuitry to communicate using cellular telephone bands at 850 MHz, 900 MHz, 1800 MHz, and 1900 MHz (e.g., the main Global System for Mobile Communications or GSM cellular telephone bands). Long-range wireless communications circuitry may also be used handle the 2100 MHz band and other bands. Electronic devices may use short-range wireless communications links to handle communications with nearby equipment. For example, electronic devices may communicate using the WiFi® (IEEE 802.11) bands at 2.4 GHz and 5 GHz (sometimes referred to as local area network bands) and the Bluetooth® band at 2.4 GHz.

It can be difficult to incorporate antennas successfully into an electronic device. Space for antennas is often limited within the confines of a device housing. Antenna operation can also be blocked by intervening metal structures. This can make it difficult to implement an antenna in an electronic device that contains conductive display structures, conductive housing walls, or other conductive structures that can potentially block radio-frequency signals.

It would therefore be desirable to be able to provide improved antennas for electronic devices.

SUMMARY

Electronic devices may be provided with conductive housing walls. Antennas in the devices may be used to handle radio-frequency signals for local area network communications and other wireless signals.

An antenna may be provided with a logo-shaped dielectric antenna window that allows the antenna to operate from within the confines of the conductive housing walls.

The logo-shaped dielectric antenna window may include a layer of glass and other dielectric materials that are transparent to radio-frequency antenna signals. A metal cavity structure with a circular outline may have a lip that is attached to the inner surface of the conductive housing walls using conductive adhesive. The metal cavity structure may form an antenna cavity for the antenna.

The metal cavity structure may have walls that are at different depths beneath the surface of the housing walls. The shallower portions of the cavity may provide more interior volume within the electronic device for mounting components. The deeper portions of the cavity may provide more separation between the conductive cavity walls and antenna resonating element structures, thereby enhancing antenna performance. The lip of the metal cavity structure may lie in the same plane as the conductive housing wall to which the metal cavity structure is mounted. The rear of the cavity structure may have a wall that is angled at a non-zero and non-perpendicular angle with respect to the planar lip.

An antenna support structure may be used to support conductive antenna elements such as an antenna resonating element and a parasitic antenna element. The antenna support structure may be formed form plastic and may be provided with voids. The voids may enhance manufacturability and may reduce dielectric loading on the antenna. The antenna resonating element may have a bent metal portion that is bent to be perpendicular to a main planar patch portion. The bent metal portion may be soldered to the metal cavity structure. The metal cavity structure may be formed from a first metal such as stainless steel or aluminum that has been plated with a second metal such as nickel or tin. The second metal may be solderable (i.e., to allow the solder connections between the antenna resonating element and the metal cavity structure to be formed).

Further features of the invention, its nature and various advantages will be more apparent from the accompanying drawings and the following detailed description of the preferred embodiments.

DETAILED DESCRIPTION

Figure 1:
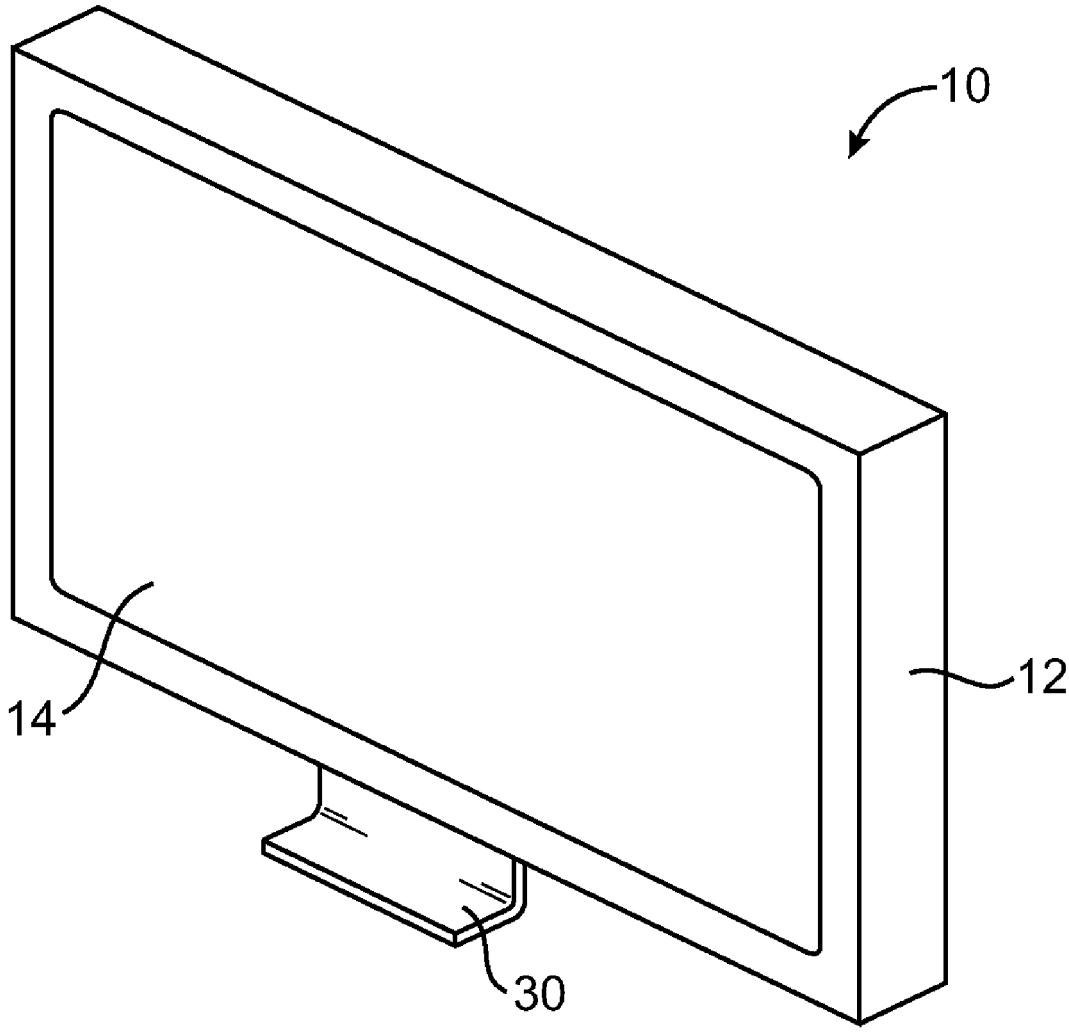
FIG. 1 is a front perspective view of an illustrative electronic device such as a computer with an antenna in accordance with an embodiment of the present invention.

Electronic devices may be provided with wireless communications circuitry. The wireless communications circuitry may be used to support wireless communications in one or more wireless communications bands. Antenna structures in an electronic device may be used in transmitting and receiving radio-frequency signals. The electronic device may have a conductive housing. For example, the electronic device may have a housing in which one or more portions are machined from blocks of aluminum or other metals. The metals may be coated with an insulating coating. For example, aluminum housing walls can be anodized. Other examples of conductive housing structures include conductive polymers, composites, and plastic structures with embedded conductive elements. Metal-filled polymers may exhibit conductivity due to the presence of conductive particles such as metal particles within the polymer material. Composite structures may include fibers such as carbon fibers that form a matrix. The matrix may be impregnated with a binder such as epoxy. The resulting composite structure may be used for an internal frame member or a housing wall and may exhibit non-negligible amounts of conductivity due to the electrical properties of the fibers and/or the binder. Plastic housing structures such as insert-molded structures may include embedded conductors such as patterned metal parts.

It can be difficult to successfully operate an antenna in an electronic device that is enclosed by conductive housing structures and conductive components such as displays. For example, conductive housing walls can block radio-frequency signals. It may therefore be desirable to provide a housing with a dielectric window structure.

To reduce visual clutter, it may be desirable to disguise or otherwise hide the antenna window. This can be accomplished by forming the window from a dielectric logo structure. With this type of arrangement, a dielectric logo may be mounted in a potentially prominent location on an electronic device housing. Because the logo carries branding information or other information that is of interest to the user of the electronic device, the logo may serve a useful and accepted information-conveying purpose and need not introduce an undesirable visible design element to the exterior of the electronic device. The dielectric materials that are used in forming the logo window or other dielectric antenna window structures may includes plastics (polymers), glasses, ceramics, wood, foam, fiber-based composites, etc. A dielectric antenna window may be formed from one of these materials or two or more of these materials. For example, a dielectric antenna window may be formed from a single piece of plastic, glass, or ceramic, or may be formed from a plastic structure that is coated with cosmetic layers of dielectric (e.g., additional plastics of different types, an outer glass layer, a ceramic layer, adhesive, etc.).

Antenna structures for the electronic device may be located under the logo or other dielectric window. This allows the antenna structures to operate without being blocked by conductive housing walls or conducting components. In configurations of this type in which the antenna structures are blocked from view but can still operate by transmitting and receiving radio-frequency signals through a logo-shaped dielectric, the antenna structures are sometimes referred to as forming logo antennas. Logo antennas may be used in environments in which other antenna mounting arrangements may be cumbersome, aesthetically unpleasing, or prone to interference due to the proximity of conductive housing walls or other conductive device structures that can block radio-frequency antenna signals.

Any suitable electronic devices may be provided with logo antennas. As an example, logo antennas may be formed in electronic devices such as desktop computers (with or without integrated monitors), portable computers such as laptop computers and tablet computers, handheld electronic devices such as cellular telephones, etc. In the illustrative configurations described herein, the logo antennas may sometimes be formed in the interior of a computer with an integrated display (sometimes referred to as an all-in-one computer or integrated desktop computer) or may be formed in a tablet-shaped portable computer. These are merely illustrative examples. Logo antennas and other antenna structures that use dielectric windows may be used in any suitable electronic device.

Logo antennas can be mounted on any suitable exposed portion of an electronic device. For example, logo antennas can be provided on the front surface of a device or on the rear surface of a device. Other configurations are also possible (e.g., with logos mounted in more confined locations, on device sidewalls, etc.). The use of logo antenna mounting locations on rear device surfaces and lower device surfaces may sometimes be described herein as examples, but, in general, any suitable logo antenna mounting location may be used in an electronic device if desired.

An illustrative electronic device such as a computer with an integrated display that may include a logo antenna is shown in FIG. 1. As shown in the illustrative front perspective view of FIG. 1, device 10 may be a computer having a housing such as housing 12. Display 14 may be mounted in housing 12. Housing 12 may be held in an upright position using stand 30.

Figure 2:
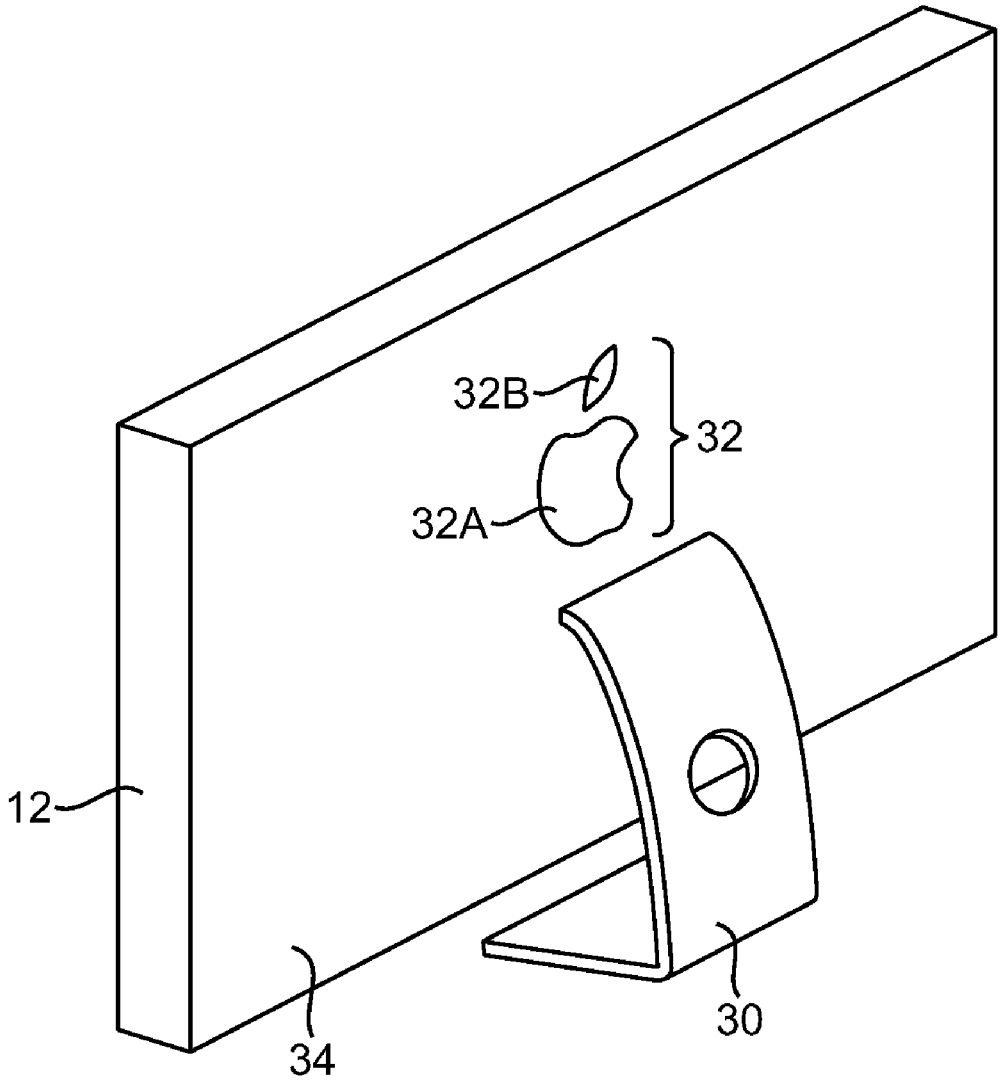
FIG. 2 is a rear perspective view of an illustrative electronic device such as a computer with an antenna in accordance with an embodiment of the present invention.

A rear perspective view of device 10 of FIG. 1 is shown in FIG. 2. As shown in FIG. 2, housing 12 may have a rear surface 34. Rear surface 34 may be substantially planar. For example, surface 34 may form a flat rectangular plane or may form a substantially planar surface that is slightly curved in one or two of its lateral dimensions. Housing 12 may be formed from structures that are conductive (e.g., metal, composites, metal-filed polymers, etc.). Device 10 may also contain displays, printed circuit boards, metal frames and other support structures, and other components that are conductive. To ensure proper operation of antenna structures that are mounted in the interior of housing 12 it may be desirable to provide housing 12 with an antenna window that is transparent to radio-frequency signals. During operation, signals can pass through the antenna window rather than being blocked by the conductive structures of device 10.

Dielectric antenna window structures such as logo-shaped antenna window structures 32 may be formed on rear housing surface 34 or other suitable portions of housing 12. All or part of structures 32 may serve as a dielectric window for an antenna that is mounted within housing 12. In the example of FIG. 2, structures 32 include structure 32A and structure 32B. Structure 32A is larger than structure 32B and may therefore be more suitable for use in forming an antenna window (as an example). In this type of configuration, structure 32B need not penetrate entirely through housing wall 34 and need not form an antenna window structure. The shape of structures 32 of FIG. 2 is merely illustrative. Any suitable shape may be used in forming dielectric antenna window structures if desired.

Figure 3:
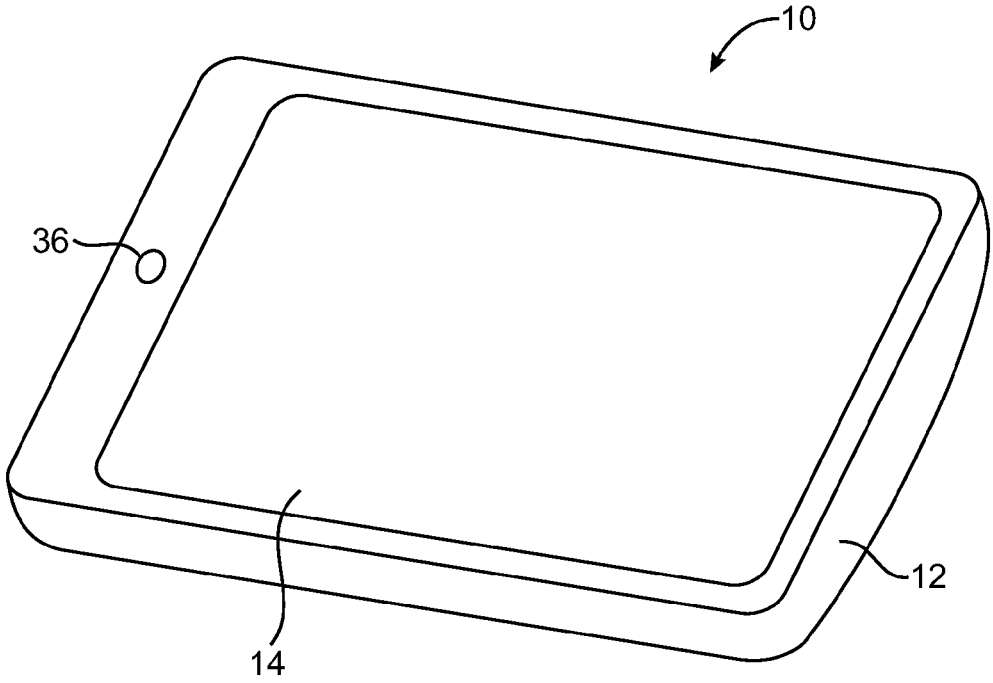
FIG. 3 is a front perspective view of an illustrative electronic device such as a tablet-shaped portable computing device with an antenna in accordance with an embodiment of the present invention.

An illustrative electronic device such as a tablet-shaped portable computer that may include a logo antenna is shown in FIG. 3. As shown in the illustrative front perspective view of FIG. 3, device 10 may have a housing such as housing 12. As with housing 12 of device 10 in the examples of FIGS. 1 and 2, some or all of housing 12 and other components in device 10 of FIG. 3 may be formed from conductive materials that tend to block radio-frequency signals. For example, housing 12 may be formed from metal (e.g., stainless steel, aluminum, etc.), conductive composites, metal-filled polymers, plastic with embedded metal parts, etc. Device 10 may also include conductive components such as display 14. Display 14 may be, for example, a liquid crystal display (LCD), an organic light-emitting diode (OLED) display, an electronic ink display, or other suitable display. A capacitive touch sensor may be incorporated into display 14 to make display 14 touch sensitive if desired. User interface components such as button 36 and the touch sensitive screen of display 14 may be used to gather user input.

Figure 4:
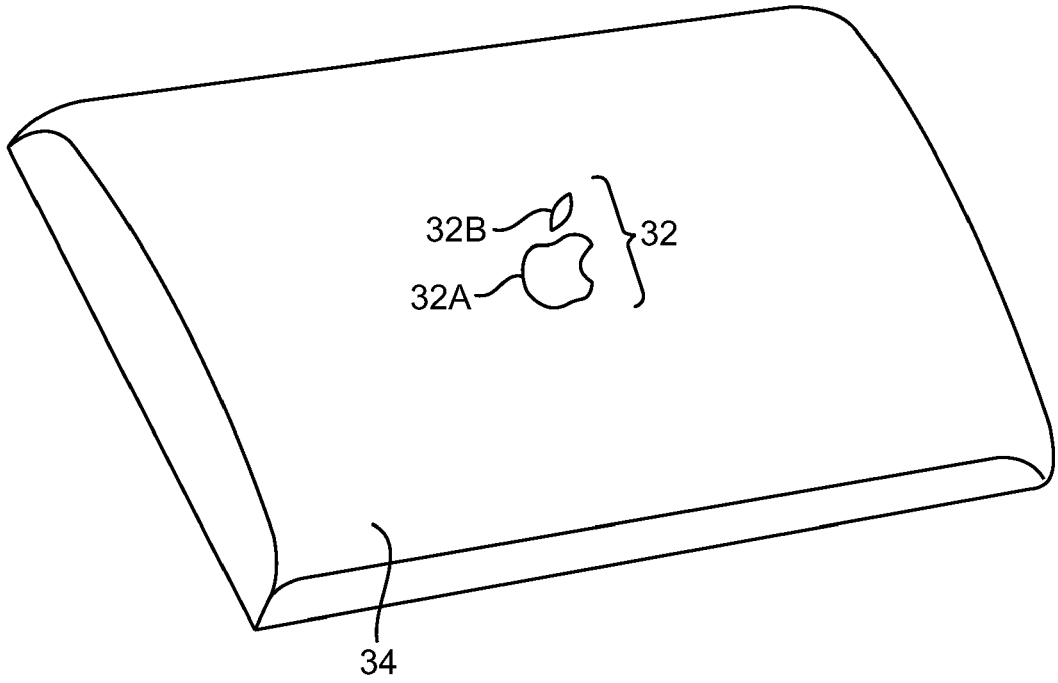
FIG. 4 is a rear perspective view of an illustrative electronic device such as a tablet-shaped portable computing device with an antenna in accordance with an embodiment of the present invention.

A rear perspective view of device 10 of FIG. 3 is shown in FIG. 4. As shown in FIG. 4, housing 12 may have a rear surface 34. Rear surface 34 may be substantially planar. For example, surface 34 may form a flat rectangular plane or, as with rear planar surface 34 of device 10 of FIG. 2, may form a substantially planar surface that is slightly curved in one or two of its lateral dimensions.

Dielectric antenna window structures such as logo-shaped antenna window structures 32 may be formed on rear housing surface 34. Structures 32 may include structures such as structure 32A and structure 32B. Structure 32A may be a dielectric structure that forms a window in conductive housing surface 34. Structure 32B may be used to help form the logo shape of structures 32 and need not be used as an antenna window (as an example).

Figure 5:
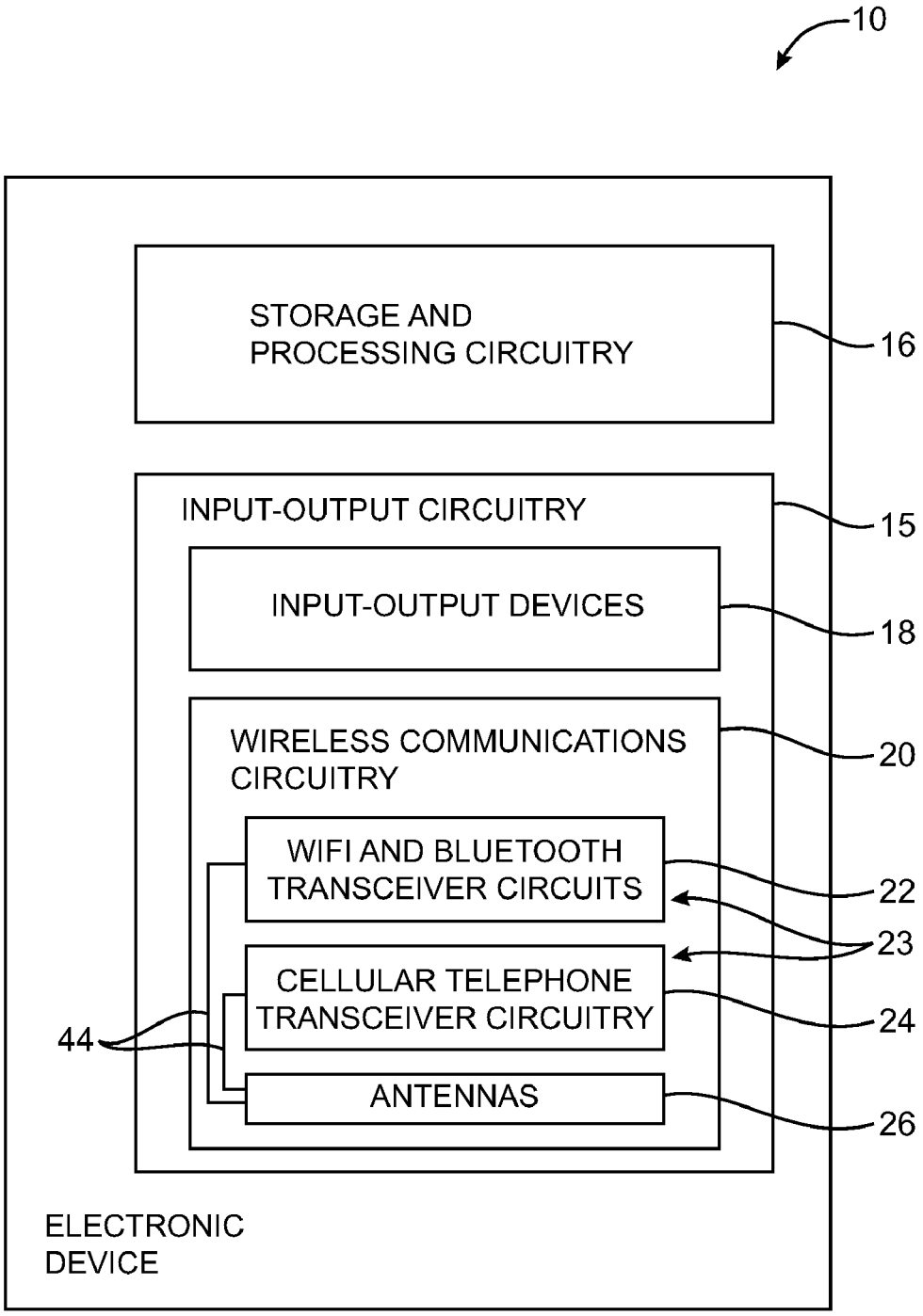
FIG. 5 is a schematic diagram of an illustrative electronic device with antenna structures in accordance with an embodiment of the present invention.

As shown in FIG. 5, electronic devices such as devices 10 of FIGS. 1-4 may include storage and processing circuitry 16. Storage and processing circuitry 16 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 16 may be used to control the operation of device 10. Processing circuitry 16 may be based on a processor such as a microprocessor and other suitable integrated circuits. With one suitable arrangement, storage and processing circuitry 16 may be used to run software on device 10, such as internet browsing applications, voice-over-internet-protocol (VOIP) telephone call applications, email applications, media playback applications, operating system functions, etc. Storage and processing circuitry 16 may be used in implementing suitable communications protocols. Communications protocols that may be implemented using storage and processing circuitry 16 include internet protocols, wireless local area network protocols (e.g., IEEE 802.11 protocols—sometimes referred to as WiFi®), protocols for other short-range wireless communications links such as the Bluetooth® protocol, etc.

Input-output circuitry 15 may be used to allow data to be supplied to device 10 and to allow data to be provided from device 10 to external devices. Input-output devices 18 such as touch screens and other user input interface are examples of input-output circuitry 15. Input-output devices 18 may also include user input-output devices such as buttons, joysticks, click wheels, scrolling wheels, touch pads, key pads, keyboards, microphones, cameras, etc. A user can control the operation of device 10 by supplying commands through such user input devices. Display and audio devices may be included in devices 18 such as liquid-crystal display (LCD) screens, light-emitting diodes (LEDs), organic light-emitting diodes (OLEDs), and other components that present visual information and status data. Display and audio components in input-output devices 18 may also include audio equipment such as speakers and other devices for creating sound. If desired, input-output devices 18 may contain audio-video interface equipment such as jacks and other connectors for external headphones and monitors.

Wireless communications circuitry 20 may include radio-frequency (RF) transceiver circuitry 23 formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 20 may include radio-frequency transceiver circuits for handling multiple radio-frequency communications bands. For example, circuitry 20 may include transceiver circuitry 22 that handles 2.4 GHz and 5 GHz bands for WiFi (IEEE 802.11) communications and the 2.4 GHz Bluetooth communications band. Circuitry 20 may also include cellular telephone transceiver circuitry 24 for handling wireless communications in cellular telephone bands such as the GSM bands at 850 MHz, 900 MHz, 1800 MHz, and 1900 MHz, and the 2100 MHz data band (as examples). Wireless communications circuitry 20 can include circuitry for other short-range and long-range wireless links if desired. For example, wireless communications circuitry 20 may include global positioning system (GPS) receiver equipment, wireless circuitry for receiving radio and television signals, paging circuits, etc. In WiFi and Bluetooth links and other short-range wireless links, wireless signals are typically used to convey data over tens or hundreds of feet. In cellular telephone links and other long-range links, wireless signals are typically used to convey data over thousands of feet or miles.

Wireless communications circuitry 20 may include antennas 26. Some or all of antennas 26 may be formed under dielectric antenna windows such as logo-shaped dielectric antenna windows (i.e., some or all of antennas 26 may be logo antennas). Antenna arrangements in which the dielectric antenna window for the antenna is formed in the shape of a logo (or part of a logo) are therefore sometimes described herein as an example. This is, however, merely illustrative. Antennas 26 may have any suitable antenna window shape if desired.

Antennas 26 may be single band antennas that each cover a particular desired communications band or may be multiband antennas. A multiband antenna may be used, for example, to cover multiple cellular telephone communications bands. If desired, a dual band logo antenna may be used to cover two WiFi bands (e.g., 2.4 GHz and 5 GHz). Different types of antennas may be used for different bands and combinations of bands. For example, it may be desirable to form a dual band antenna for forming a local wireless link antenna, a multiband antenna for handling cellular telephone communications bands, and a single band antenna for forming a global positioning system antenna (as examples).

Paths 44 such as transmission line paths may be used to convey radio-frequency signals between transceivers 22 and 24 and antennas 26. Radio-frequency transceivers such as radio-frequency transceivers 22 and 24 may be implemented using one or more integrated circuits and associated components (e.g., switching circuits, matching network components such as discrete inductors, capacitors, and resistors, and integrated circuit filter networks, etc.). These devices may be mounted on any suitable mounting structures. With one suitable arrangement, transceiver integrated circuits may be mounted on a printed circuit board. Paths 44 may be used to interconnect the transceiver integrated circuits and other components on the printed circuit board with logo antenna structures in device 10. Paths 44 may include any suitable conductive pathways over which radio-frequency signals may be conveyed including transmission line path structures such as coaxial cables, microstrip transmission lines, etc.

Logo antennas 26 may, in general, be formed using any suitable antenna types. Examples of suitable antenna types for logo antennas 26 include antennas with resonating elements that are formed from patch antenna structures, inverted-F antenna structures, structures that exhibit both patch-like and inverted-F-like structures, closed and open slot antenna structures, loop antenna structures, monopoles, dipoles, planar inverted-F antenna structures, hybrids of these designs, etc. All or part of a logo antenna may be formed from a conductive portion of housing 12. For example, housing 12 or a part of housing 12 may serve as a conductive ground plane for a logo antenna.

Conductive cavities may also be provided for antennas 26. Portions of housing 12 and/or separate conductive cavity structures may, for example, form an antenna cavity for an antenna with a logo-shaped dielectric window (e.g., to form a cavity-backed logo antenna design).

Figure 6:
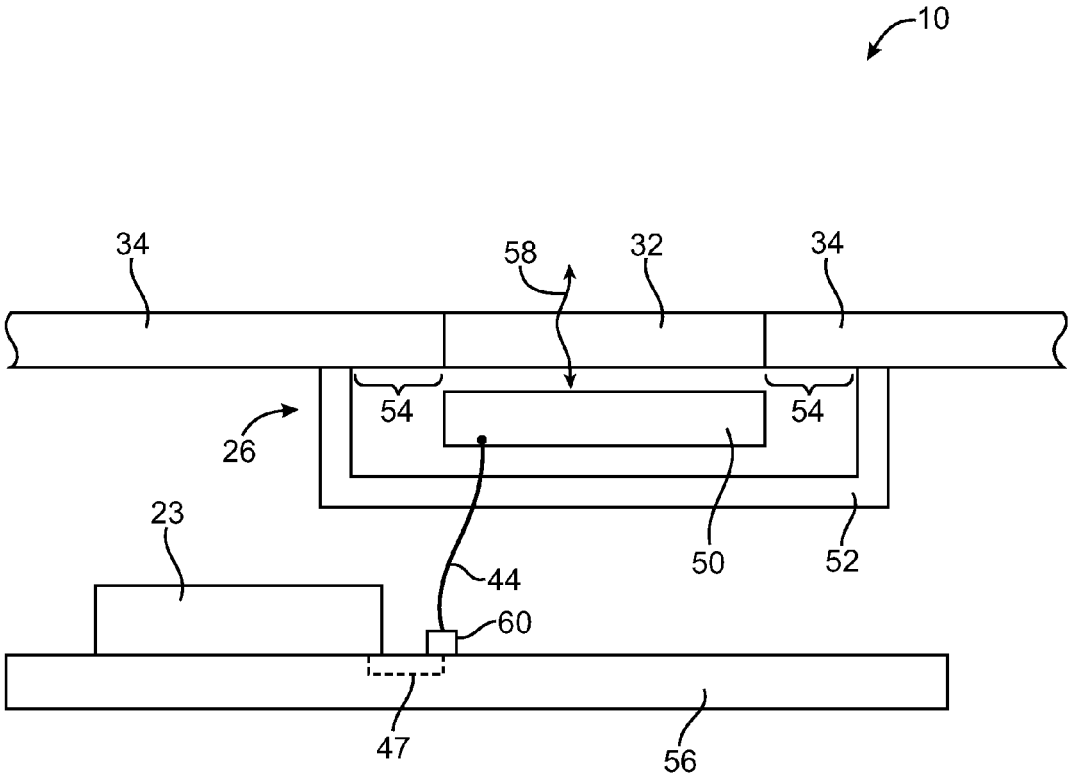
FIG. 6 is a cross-sectional side view of an electronic device with antenna structures that include an antenna cavity mounted against conductive housing walls in accordance with an embodiment of the present invention.

A cross-sectional side view of an illustrative cavity-backed antenna 26 of the type that may be used in device 10 is shown in FIG. 6. As shown in FIG. 6, antenna window 32 may be formed in conductive housing wall 34. Antenna 26 may be mounted in the interior of device 10. As illustrated by radio-frequency signal 58, the presence of antenna window 32 allows radio-frequency antenna signals to pass between antenna 26 and the exterior of device 10.

Antenna 26 may be formed from antenna structures 50 and 52. Structure 52 may also form part of a cavity for antenna 26. Some of housing walls 34 (e.g., overhanging housing wall portions 54) may also form part of the cavity. Antenna structures 50 may include an antenna resonating element such as a patch-type antenna resonating element.

Structures 50 and the antenna cavity (e.g., the cavity formed from cavity wall structure 52 and cavity wall portions 54) may be coupled to a coaxial cable or other transmission line 44. For example, a coaxial cable ground conductor may be coupled to cavity structure 52 and may be coupled to an antenna feed terminal (e.g., a ground feed) within antenna structure 50. A coaxial cable signal conductor may be coupled to another antenna feed terminal (e.g., a positive feed) that is associated with the resonating element in antenna structure 50.

Transmission line 44 may be coupled to transceiver circuitry 23 on printed circuit board 56 using connector 60 and transmission line traces 47. Circuitry 23 may also be coupled to other antennas (e.g., antennas that are used to implement an antenna diversity scheme).

Antennas such as antenna 26 of FIG. 6 may operate at any suitable frequencies. As an example, antenna 26 may be a dual band antenna that operates in first band such as a 2.4 GHz WiFi® band and that operates in a second band such as a 5 GHz WiFi® band.

Figure 7:
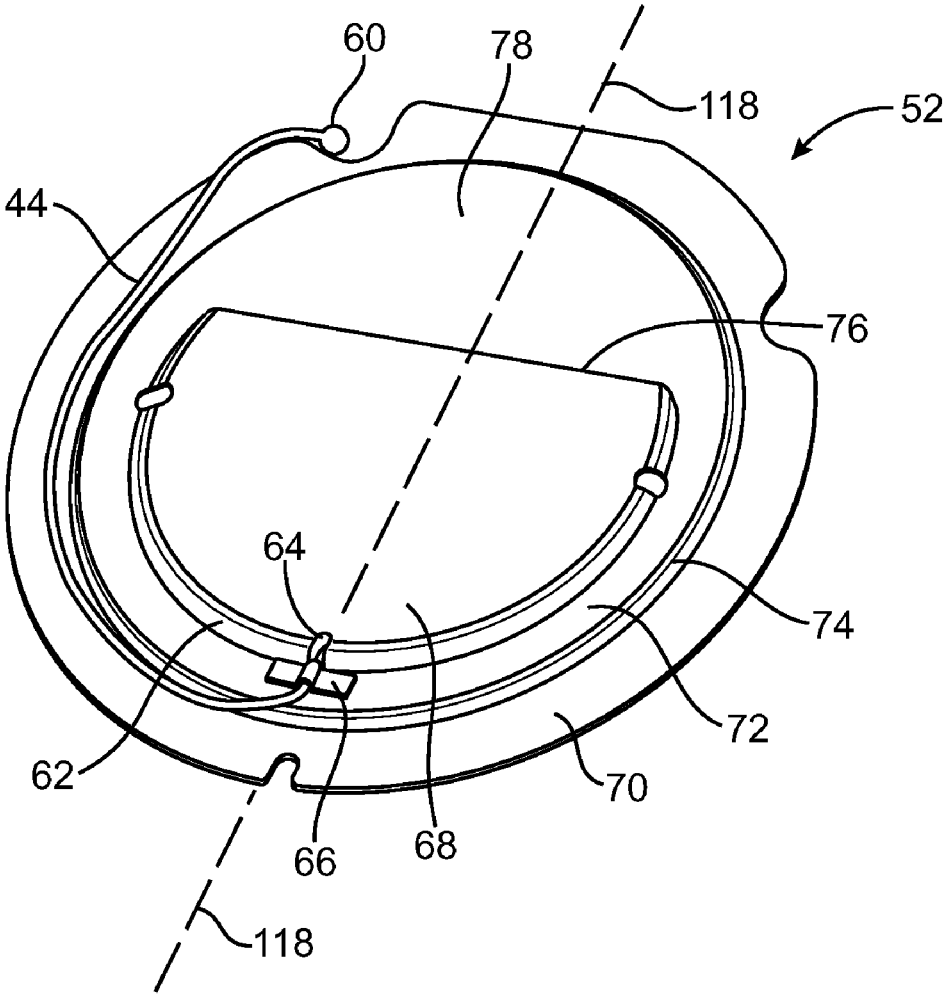
FIG. 7 is a rear perspective view of a conductive antenna cavity structure that may be used to form part of an antenna for an electronic device in accordance with an embodiment of the present invention.

A rear perspective view of an illustrative cavity structure 52 for antenna 26 is shown in FIG. 7. Cavity structure 52 may be formed from a conductive material such as metal. For example, cavity structure 52 may be formed from stainless steel, aluminum, or other metals. If desired, cavity structure 52 may be plated. For example, cavity structure 52 may be plated with a thin metal coating of a solderable metal such as nickel or tin. By forming cavity structure 52 from two metals, cavity structure 52 can be formed from a material that is not too costly and that is not overly difficult to shape during manufacturing operations (e.g., stainless steel or aluminum) without compromising its ability to form solder connections. Solder will adhere well to the outer (plated) metal layer thereby facilitating the formation of solder connections. Solder connections may be used to attach conductive elements such as transmission line elements and the antenna resonating element of antenna 26 to cavity structure 52.

As shown in FIG. 7, cavity structure 52 may have a circular outline. Outlines of other shapes may also be used (e.g., oval shapes, rectangular shapes, rectangles with rounded corners, triangular shapes, shapes with more than four sides, outline shapes with both curved and straight segments, etc.). The use of a circular shape for cavity structure 52 in the example of FIG. 7 is merely illustrative.

Coaxial cable 44 may have a connector such as connector 60 at one end that allows cable 44 to be coupled to printed circuit board 56 (FIG. 6) and, through traces on board 56, to be coupled to transceiver circuitry 23. At the other end of cable 44, cable 44 may be passed through hole 64 in cavity structure 52. Support structure 66 may be used to help hold cable 44 in place on cavity structure 52. Support structure 66 may be formed from metal or other suitable materials and may be attached to cavity structure 52 using welds, adhesive, or other suitable fastening mechanisms.

Cavity structure 52 may have an outer rim 70 that forms a planar circular lip. Lip 70 may facilitate attachment of cavity structure 52 to the interior surface of housing wall 34. A substantially vertical cavity wall 74 may be formed in a circle around the inner perimeter of lip 70. Circular region 72 may be formed in the portions of cavity structure 52 that lie within the circular outline of wall 74. Region 72 may be planar and may lie parallel to the substantially planar surfaces of lip 70. Planar portion 68 may form the lowermost surface of cavity structure 52. In the example of FIG. 7, planar portion 68 is angled at a non-zero and non-perpendicular angle with respect to the planes of surface 72 and surface 70. As a result, portion 68 has a "deep" portion (i.e., the portion near semi-circular cavity wall 62) and has a shallow portion (i.e., the portion that abuts linear boundary 76).

Because of the angled shape of rear cavity wall 68, the antenna cavity has deeper portions and shallower portions. The deeper cavity portions are the cavity portions associated with angled surface 68. The shallower cavity portions are the cavity portions for which planar surfaces 72 and 78 form a lower planar cavity wall. Cavities shapes such as these, which have rear walls at different depths, may be used to maximize the volume of the antenna cavity and the separation between conductive cavity walls and the antenna resonating element structures of antenna structures 50 while simultaneously accommodating desired components within housing 12.

Any suitable layout may be used for the conductive antenna structures that make up antenna structures 50 of FIG. 6. In a typical configuration, antenna resonating element structures are formed from conductive traces on a substrate. The substrate may be formed form a flexible or rigid printed circuit board. Flexible printed circuit boards "flex circuits" may be formed from polymers such as polyimide. Rigid printed circuit boards may be formed from fiberglass-filled epoxy (as an example). Support structures for printed circuit board substrates may be formed from dielectric (e.g., from plastic parts). Conductive antenna structures may also be formed from stamped metal foil, from wires, from traces that are formed directly on plastic support structures, or using any other suitable arrangement.

Figure 8:
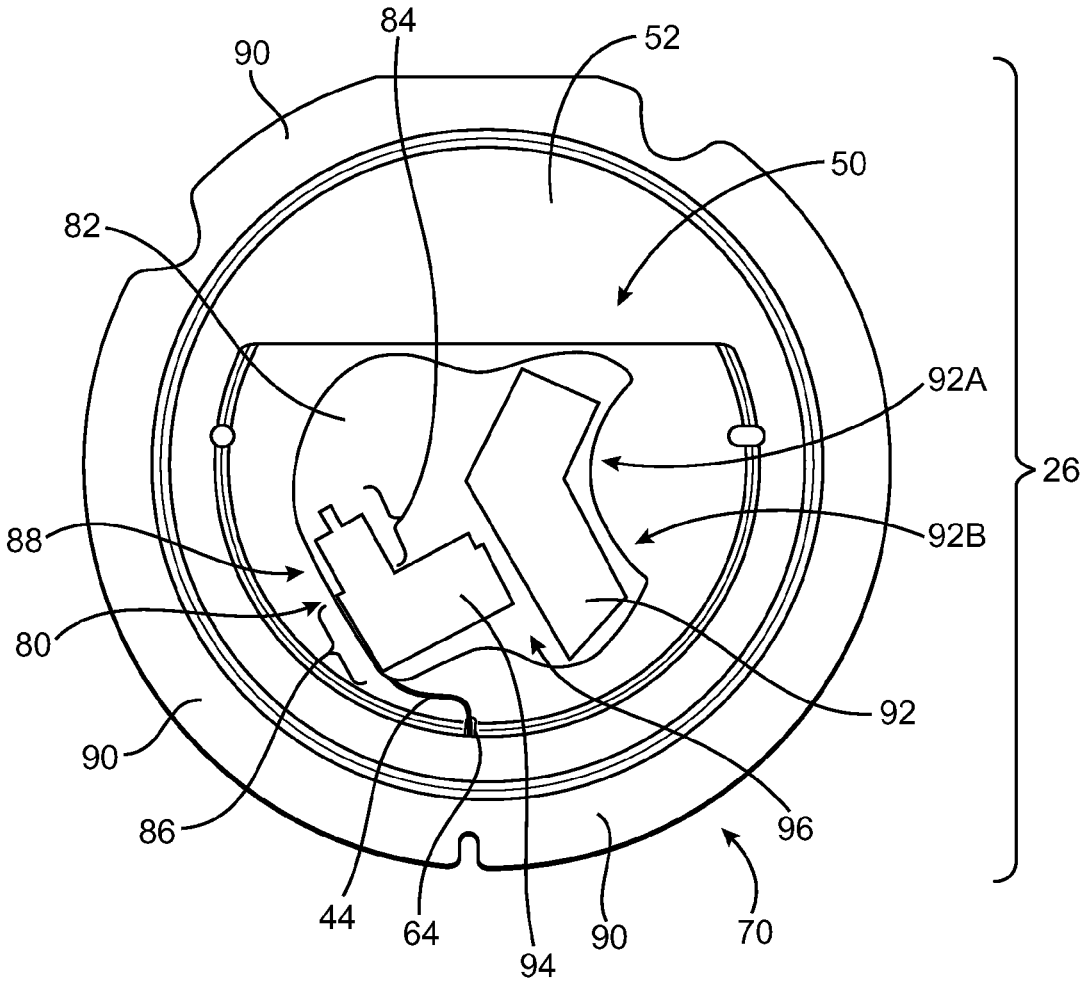
FIG. 8 is a top view of structures in a cavity antenna of the type that may be used in an electronic device in accordance with an embodiment of the present invention.

An example of a suitable layout that may be used for antenna structure 50 (FIG. 6) is shown in FIG. 8. In the example of FIG. 8, antenna structure 50 forms a dual band antenna (e.g., a WiFi® antenna that resonates at 2.4 GHz and 5 GHz). Other bands may be supported if desired.

As shown in FIG. 8, antenna 26 may be formed from cavity structure 52 (e.g., a circular metal can structure) and antenna structure 50 (e.g., conductive traces such as antenna resonating element 94 and parasitic antenna element 92). Cavity structure 52 may be formed from a thin sheet of plated metal or other suitable conductor that has been formed into the shape shown in FIG. 7. Conductive adhesive 90 may be placed over lip 70 to facilitate attachment of cavity structure 52 to the underside of housing walls 34. Other attachment arrangements may also be used (e.g., screws, welds, etc.).

Antenna resonating element 94 and parasitic antenna element 92 may be formed from traces of copper, gold, gold-plated copper, other suitable metals, or other conductors on a flex circuit or rigid printed circuit board substrate. Conductive elements such as antenna resonating element 94 and parasitic antenna element 92 may also be formed from thin sheets of metal (e.g., metal foil) that has been stamped or otherwise patterned into desired shapes. Parasitic antenna element 92 may be electrically isolated from antenna resonating element 94 (i.e., there may be no electrical traces that electrically short antenna resonating element 94 to parasitic antenna element 92). Parasitic antenna element 92 is, however, electromagnetically coupled to antenna resonating element 94 (i.e., by near-field coupling).

Antenna support structure 82 may be formed from plastic, glass, ceramic, or other suitable dielectrics and may be used to support antenna resonating element 94 and parasitic antenna element 92. Support structure 82 may, for example, be formed from a rigid injection-molded plastic part. Antenna support structure 82 may form part of dielectric antenna window 32 (FIG. 6) and may therefore be provided in the shape of a logo that matches the shape of logo antenna window 32A of FIG. 2 (as an example).

Antenna resonating element 94 may be fed at antenna feed 88. Antenna feed 88 may include a ground antenna feed terminal and a positive antenna feed terminal. Coaxial cable 44 may be routed within antenna support structure 82 along edge 80.

Antenna resonating element 94 may include first portion 84 and second portion 86. Portions 84 and 86 may have the shape of rectangles (as an example) and may serve as branches (also sometimes referred to as arms or stubs) for antenna resonating element 94. The overall frequency response of antenna resonating element 94 includes a first gain peak centered at 2.4 GHz for the low band of antenna 26 and a second gain peak centered at 5 GHz for the high band of antenna 26. The size and shape of resonating element portion 84 (i.e., the smaller of the two stubs for resonating element 94) may have relatively more impact on the bandwidth and resonant frequency for the low band, whereas the size and shape of resonating element portion 86 may have relatively more impact on the bandwidth and resonant frequency for the high band.

Parasitic antenna element 92 may have a first portion 92A and a second portion 92B that are angled with respect to each other. Parasitic antenna element 92 may be separated from antenna resonating element 94 by a gap such as gap 96. In the absence of parasitic antenna element 92, antenna 26 may exhibit a gain at 5 GHz that is slightly in excess of regulatory limits. This is due to the generally directional nature of antenna 26, which tends to radiate in a direction perpendicular to the plane of the antenna cavity rear wall (i.e., outwards at an angle that is substantially perpendicular to the plane of housing surface 34). The presence of parasitic antenna resonating element 92 can help to reduce the directionality of antenna 26 sufficiently to ensure that applicable regulatory requirements for peak gain are satisfied.

Figure 9:
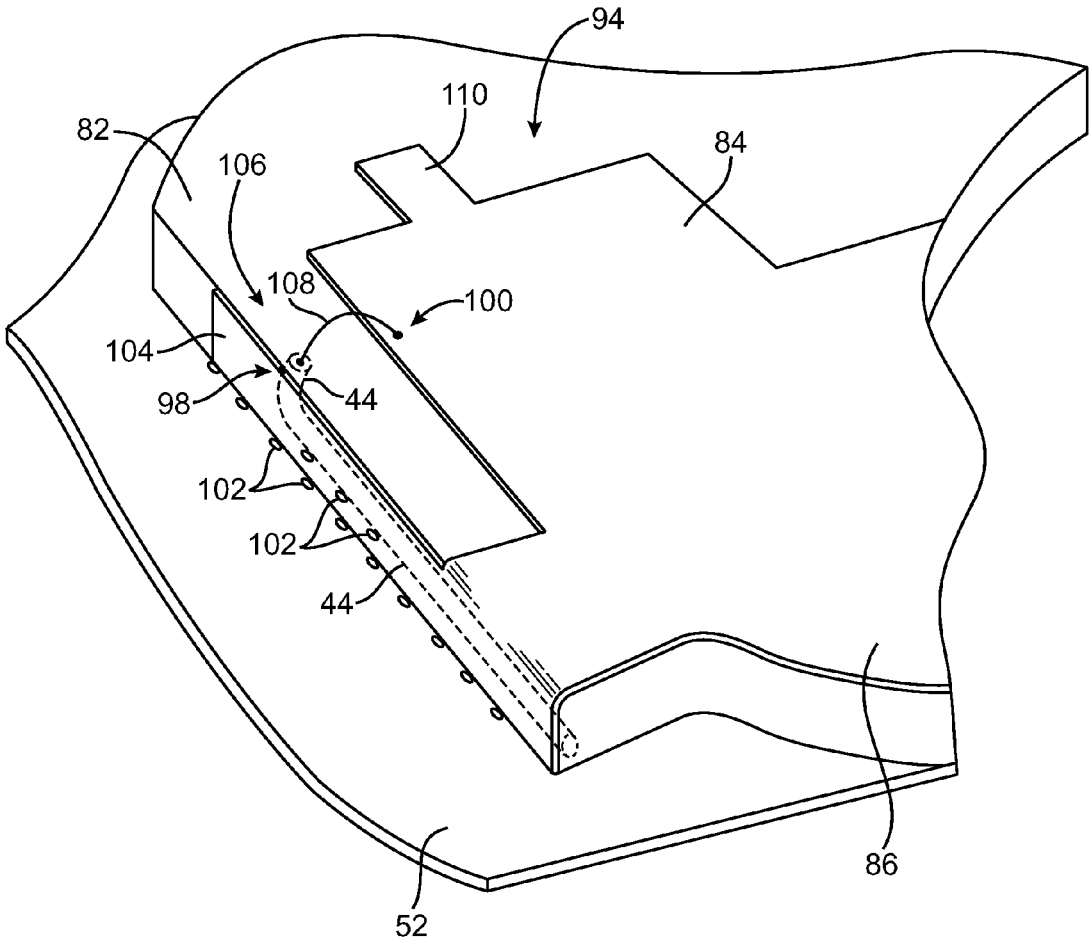
FIG. 9 is a perspective view of a portion of a cavity antenna of the type shown in FIG. 8 showing how the antenna may be fed by a coaxial cable transmission line in accordance with an embodiment of the present invention.

FIG. 9 is a more detailed perspective view of antenna 26 in the vicinity of feed 88. As shown in FIG. 9, antenna support structure 82 may be formed on the inner surface of cavity structure 52. Antenna resonating element 94 may have a bent portion that forms vertical sidewall 104. Coaxial cable 44 may run along the interior of support structure 82 and may exit support structure 82 in the vicinity of antenna feed 88. Vertical sidewall 104 may be soldered to cavity structure 52 at solder points 102. Solder 102 may also be used to solder an outer ground conductor associated with coaxial cable 44 to an interior portion of vertical sidewall 104 and/or antenna cavity structure 52.

Antenna feed 88 may include a ground antenna feed terminal (see, e.g., feed terminal 98) that is formed by soldering the outer ground conductor associated with cable 44 to vertical sidewall 104. Antenna feed 88 may also have a positive antenna feed terminal 100 that is formed by soldering coaxial cable center conductor 108 to portion 84 of antenna resonating element 94.

Portion 84 of antenna resonating element 94 may be separated from sidewall 104 by gap 106. Features such as protruding feature 110, the size and shape of portions 84 and 86, the size and shape of gap 108, the size and shape of antenna parasitic element 92 (FIG. 8), the size and shape of gap 106, and the size and shape of the antenna cavity are examples of antenna features that may be adjusted to help tune the performance characteristics of antenna 26.

Figure 10:
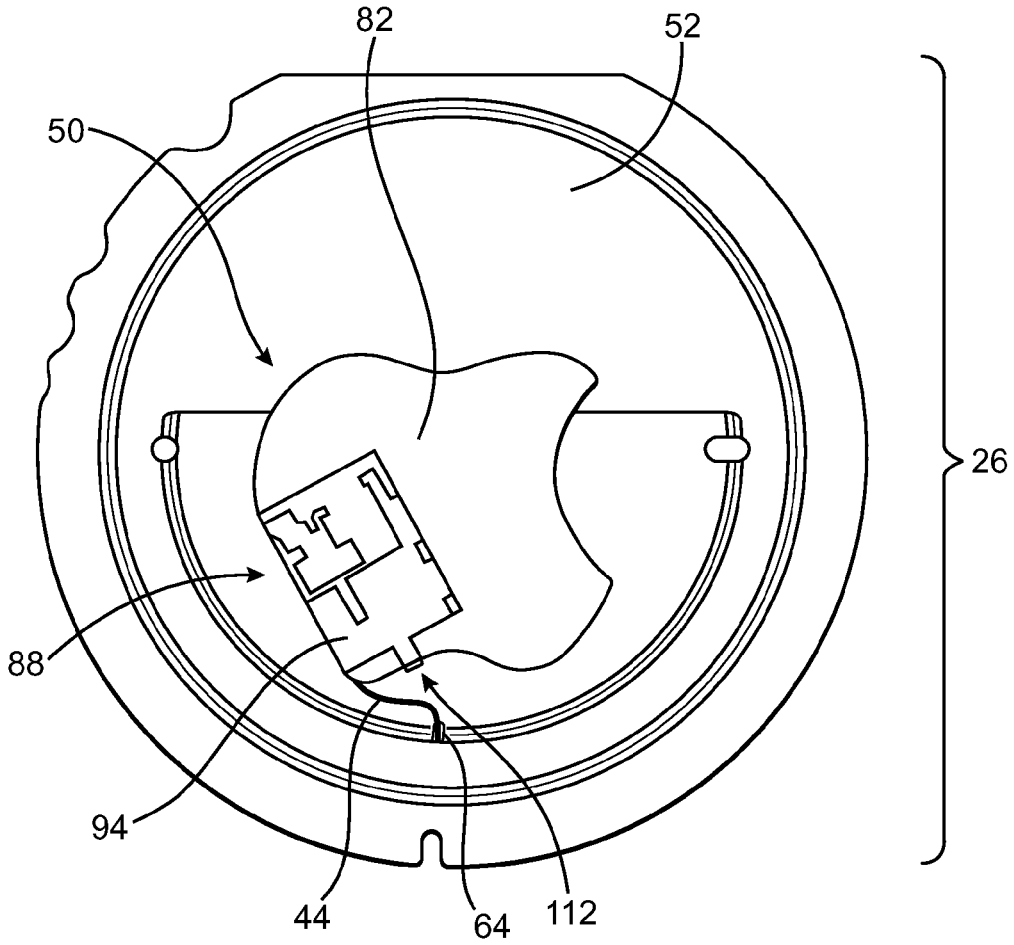
FIG. 10 is a top view of portions of another illustrative cavity antenna that may be used in an electronic device in accordance with an embodiment of the present invention.

Another illustrative resonating element pattern that may be used for antenna structure 50 is shown in FIG. 10. As with the example of FIG. 8, antenna support structure 82 may be formed on the rear (bottom) surface of antenna cavity 52 and may have the shape of a logo. Antenna resonating element 94 may be fed at antenna feed 88 using a feed arrangement of the type shown in FIG. 9. Shorting conductor 112 may form a vertical short to the rear wall of antenna cavity 52) that helps tune antenna 26.

Figure 11:
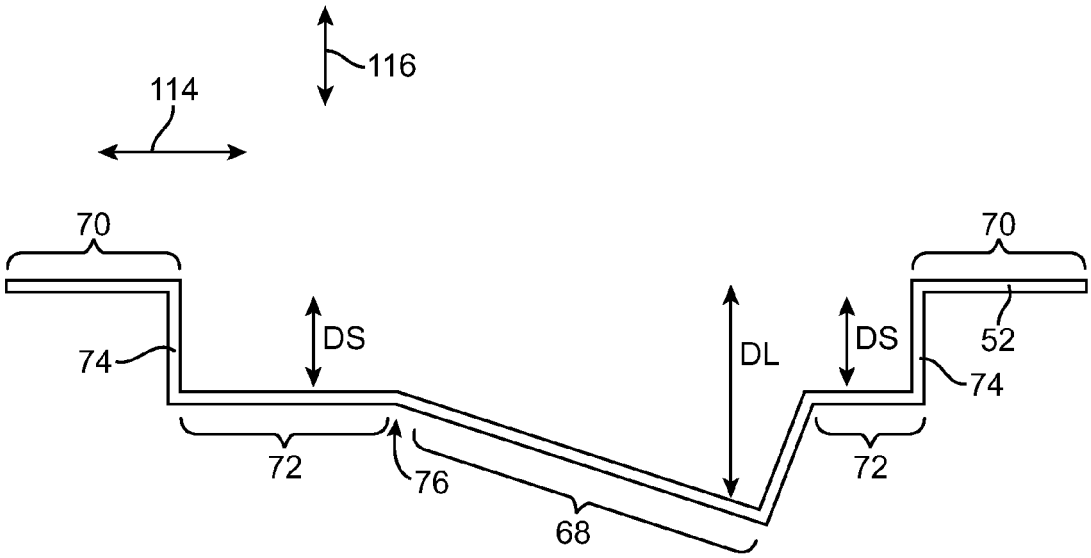
FIG. 11 is a cross-sectional side view of an illustrative conductive antenna cavity structure that may be used as part of a cavity antenna in an electronic device in accordance with an embodiment of the present invention.

As described in connection with FIG. 7, antenna cavity 50 may have some portions that are deeper than others. This use of a rear wall of varying depth is illustrated in the cross-sectional side view of FIG. 11. The cross-sectional side view of FIG. 11 is taken along line 118 of FIG. 7. As shown in FIG. 11, antenna cavity structure 52 may include planar lip portions 70 that run parallel to horizontal direction 114 (in the orientation of FIG. 11). Antenna cavity structure 52 may also have vertical wall portions 74 that run parallel to vertical direction 116 (in the FIG. 11 orientation). Regions 72 may run parallel to horizontal direction 114 and the plane of planar lip 70. Planar regions 72 lie at a depth DS below the surface of lips 70. Angled portion 68 allows the lowermost surface of cavity structure 52 to become deeper than depth DS (i.e., the deepest portions of angled cavity wall 68 may have a depth DL). By increasing the depth of cavity 52, the distance between the conductive cavity surfaces and antenna structure 50 (e.g., antenna resonating element 94 and parasitic element 92) may be maximized, thereby enhancing antenna bandwidth.

Figure 12:
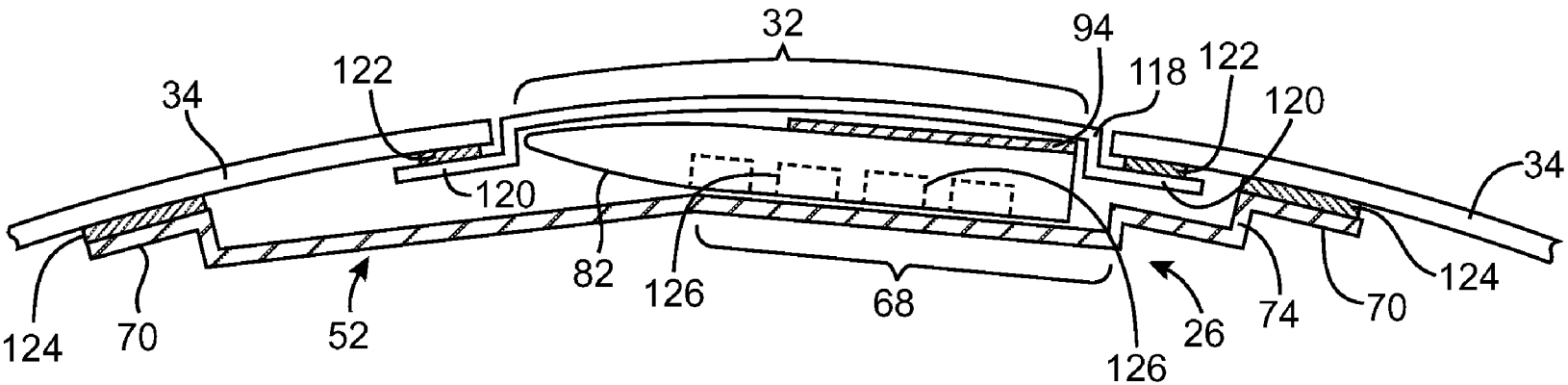
FIG. 12 is a cross-sectional side view of an illustrative cavity antenna mounted in an electronic device housing wall under a dielectric window such as a logo-shaped window in accordance with an embodiment of the present invention.

As shown in the cross-sectional side view of FIG. 12, antenna support structure 82 may have a shape that conforms to the angled cavity shape of cavity structure 52. Conductive adhesive 124 may be used to attach lip 70 of antenna cavity structure 52 to the lower (inner) surfaces of housing wall 34. Adhesive 122 may be used to attach lip 120 of dielectric logo member 118 to the underside of housing walls 34. Antenna traces such as antenna resonating element 94 may be supported by antenna support structure 82 beneath the lower surface of dielectric logo member 118. Dielectric logo member 118 may have an outline of a logo when viewed from the exterior of housing 12 (i.e., member 118 may serve as window 32A of FIG. 2). The surface of dielectric logo member 118 is visible to users of device 10 and may therefore be provided with an attractive finish. With one suitable arrangement, member 118 is formed from one or more layers that have an aesthetically appealing appearance such as polished glass layers, ceramic layers, plastic layers, etc.

During operation of antenna 26, radio-frequency signals pass through dielectric logo member 118. In this respect, dielectric logo member 118 serves as dielectric antenna window 32. Radio-frequency antenna signals also resonate within the antenna cavity formed by antenna cavity structure 52 and overhanging conductive housing walls 34. Antenna support structure 82 is formed within this cavity. To avoid excessive bandwidth narrowing due to dielectric loading from antenna support structure 82 in the antenna cavity, it may be desirable to form antenna support structure 82 from a material that has a relatively low dielectric constant. Voids may also be formed in antenna support structure such as voids 126. Voids 126 may be filled with air, which reduces the overall dielectric constant of structure 82 and thereby tends to enhance the bandwidth of antenna 26.

Figure 13:
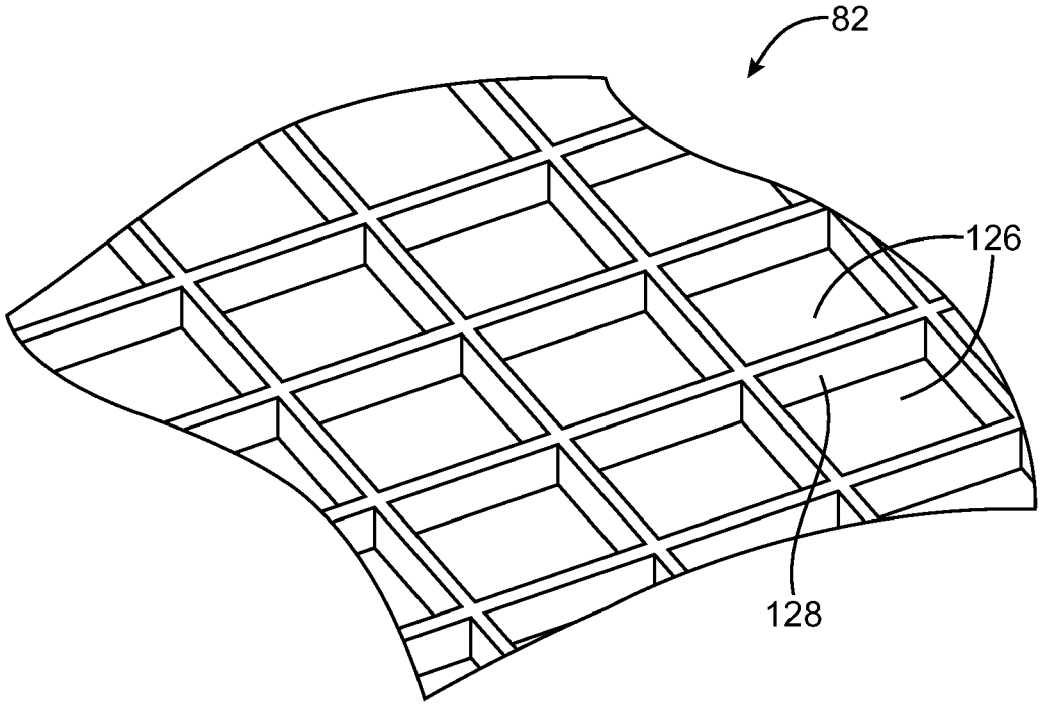
FIG. 13 is a perspective view of a portion of a dielectric antenna support structure with a waffle-shaped pattern of voids in accordance with an illustrative embodiment of the present invention.

A perspective view of a portion of antenna support structure 82 showing an illustrative waffle-shaped pattern of voids 126 that may be used in antenna support structure 82 is shown in FIG. 13. As shown in FIG. 13, voids 126 may be formed in an array having multiple rows and columns of voids that are separated by a grid-shaped pattern of vertical support structure walls 128. This is merely illustrative. Any suitable pattern of voids may be used in support structure 82 if desired.

Support structure 82 may be formed from a dielectric such as plastic. The plastic may be, for example, a thermoplastic (e.g., a material such as acrylonitrile butadiene styrene (ABS), polycarbonate (PC), or an ABS/PC blend). The plastic may be formed into a desired shape for support structure 82 using injection molding. The pattern of voids 126 and walls 128 that are used for support structure 82 (e.g., the illustrative pattern of FIG. 13) may help ensure that the molded part has sufficiently uniform wall thicknesses, so that the injection molding process is not adversely affected by excessive part thickness variations.

Figure 14:
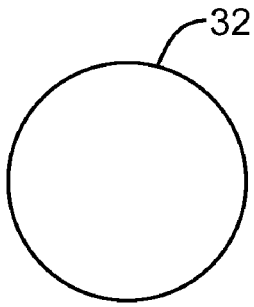
FIG. 14 is a top view of a circular logo-shaped dielectric antenna window for an electronic device cavity antenna in accordance with an embodiment of the present invention.

A logo antenna may be formed behind a dielectric window of any suitable configuration. As an example, a logo antenna may be formed from a circular dielectric window structure such as dielectric window 32 of FIG. 14.

Figure 15:
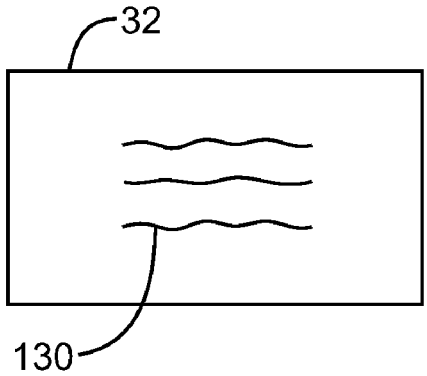
FIG. 15 is a top view of a rectangular logo-shaped dielectric antenna window for an electronic device cavity antenna in accordance with an embodiment of the present invention.

As shown by rectangular dielectric window structure 32 of FIG. 15, dielectric window structures for logo antenna 26 may be rectangular or may have other non-circular shapes. If desired, structures such as window structure 32 of FIG. 14 and window structure 32 of FIG. 15 may be provided with colored regions, text, graphics, surface texture, or other features that allow window structure 32 to convey visual information to a user. This information, which is shown schematically by lines 130 in FIG. 15, may include brand name information, promotional text, product information, product type information, or other promotional information. As an example, information 130 may include a company name, a product name, a trademark, a personalized message, or other suitable visual indicator that conveys information of promotional value or other value to a user of device 10. In a typical scenario, dielectric window 32 may include information 130 such as the name of the manufacturer of device 10. Sometimes logos can convey this information without text or by using a logo shape in combination with text, graphics, colors, etc. In the example of FIGS. 2 and 4, dielectric window 32 is a logo-shaped dielectric window having the trademark shape of a well known manufacturer of electronic devices (Apple Inc. of Cupertino, Calif.). These are merely illustrative examples. Logo antenna 26 may have any suitable dielectric logo structure that serves as a dielectric antenna window.

The foregoing is merely illustrative of the principles of this invention and various modifications can be made by those skilled in the art without departing from the scope and spirit of the invention.

What is claimed is:

1. An electronic device with a logo antenna, comprising:

a conductive housing wall;

a dielectric logo structure in the conductive housing wall that serves as a dielectric antenna window for the logo antenna;

an antenna resonating element for the logo antenna that is mounted behind the dielectric logo structure so that radio-frequency antenna signals pass from the antenna resonating element through the dielectric logo structure; and a dielectric support structure that supports the antenna resonating element and that has at least one void.

2. The electronic device defined in claim 1 further comprising:

a conductive cavity structure in which the dielectric support structure is mounted, wherein the conductive cavity structure forms an antenna cavity for the logo antenna.

3. The electronic device defined in claim 2 wherein the conductive cavity structure has a circular outline.

4. The electronic device defined in claim 2 wherein the conductive cavity has a peripheral lip and wherein the electronic device further comprises conductive adhesive interposed between the peripheral lip and the conductive housing wall that attaches the conductive cavity to the conductive housing wall.

5. The electronic device defined in claim 4 wherein the peripheral lip comprises a planar lip with planar structures that lie in a plane and wherein the conductive cavity comprises a rear wall having at least some planar portions that are angled with respect to the plane at a non-zero and non-perpendicular angle.

6. The electronic device defined in claim 2 further comprising:

a coaxial cable that conveys radio-frequency antenna signals and that is coupled to the logo antenna;

a hole in the conductive cavity structure through which the coaxial cable passes.

7. The electronic device defined in claim 1 wherein the dielectric support structure comprises a rigid dielectric material comprising a plurality of air-filled voids.

8. The electronic device defined in claim 7 further comprising:

a conductive cavity structure in which the dielectric support structure is mounted, wherein the conductive cavity structure forms an antenna cavity for the logo antenna.

9. The electronic device defined in claim 1 wherein the dielectric support structure comprises a plastic member with a plurality of air-filled voids arranged in an array of rows and columns.

10. The electronic device defined in claim 9 further comprising:

a conductive cavity structure in which the dielectric support structure is mounted, wherein the conductive cavity structure forms an antenna cavity for the logo antenna.

11. The electronic device defined in claim 10 wherein the conductive cavity structure comprises a first metal coated with a layer of a second metal, wherein the second metal comprises a solderable metal, the electronic device further comprising solder that connects the antenna resonating element to the second metal.

12. Apparatus, comprising:

an electronic device conductive housing wall having an opening;

a dielectric structure in the opening of the conductive housing wall that serves as a dielectric antenna window for an antenna;

an antenna resonating element for the antenna that is mounted behind the dielectric structure so that radio-frequency antenna signals pass from the antenna resonating element through the dielectric structure; and a conductive cavity structure having a planar lip with a curved outline that is attached to the conductive housing wall so that a portion of the conductive housing wall overhangs the conductive cavity structure, wherein the conductive cavity structure and the portion of the conductive housing wall that overhangs the conductive cavity structure form an antenna cavity for the antenna.

13. The apparatus defined in claim 12 further comprising conductive adhesive interposed between the planar lip and the conductive housing wall.

14. The apparatus defined in claim 13 further comprising:

a computer display;

a housing in which the computer display is mounted; and a stand on which the housing is mounted, wherein the housing has a rear surface that contains the conductive housing wall.

15. The apparatus defined in claim 14 wherein the dielectric structure comprises a logo.

16. The apparatus defined in claim 15 wherein the conductive cavity structure comprises a first metal plated with a second metal that accepts solder connections, the apparatus further comprising solder that connects the antenna resonating element to the second metal.

17. The apparatus defined in claim 16 wherein the antenna comprises a dual band antenna that handles radio-frequency antenna signals in bands at 2.4 GHz and 5 GHz and wherein the antenna resonating element has a first portion that is configured to influence antenna performance in the 2.4 GHz band more than in the 5 GHz band and that has a second portion that is configured to influence antenna performance in the 5 GHz band more than in the 2.4 GHz band.

18. The apparatus defined in claim 12 wherein the planar lip lies in a plane and wherein the conductive cavity comprises rear wall structures having a plurality of different depths below the plane.

19. An antenna, comprising:

a conductive electronic device housing wall having an opening;

a dielectric logo structure mounted in the opening, wherein the dielectric logo has a logo-shaped outline;

a dielectric support structure having an outline that matches at least some of the logo-shaped outline; and an antenna resonating element mounted on the dielectric support structure.

20. The antenna defined in claim 19 further comprising a metal cavity structure in which the dielectric support structure is mounted, wherein the metal cavity structure comprises a first metal plated with a second metal and forms at least part of an antenna cavity for the antenna.

21. The antenna defined in claim 20 wherein the second metal is selected from the group consisting of:

nickel and tin.

22. The antenna defined in claim 20 wherein the dielectric logo structure comprises glass.

23. The antenna defined in claim 20 wherein at least a portion of the conductive electronic device housing wall overhangs the metal cavity structure and forms part of the antenna cavity.

24. Apparatus, comprising:

an antenna resonating element for a logo antenna;

a parasitic antenna element that is electrically isolated from the antenna resonating element and that is electromagnetically near-field coupled to the antenna resonating element;

a dielectric antenna window that forms a logo for the logo antenna; and a plastic support structure for the parasitic antenna element and the antenna resonating element, wherein the plastic support structure has at least one void.

25. The apparatus defined in claim 24 further comprising an antenna cavity for the logo antenna, wherein the antenna resonating element and the parasitic antenna element are mounted within the antenna cavity.

26. The apparatus defined in claim 25 wherein the logo antenna is configured to operate in a first band at 2.4 GHz and in a second band at 5 GHz and wherein the antenna cavity comprises a metal antenna cavity structure.

27. The apparatus defined in claim 26 further comprising metal computer housing walls that form at least part of the antenna cavity.

28. The apparatus defined in claim 25 wherein the plastic support structure is mounted within the antenna cavity and wherein the plastic support structure has an array of voids that includes the at least one void and that reduce dielectric loading on the antenna by the plastic support structure.

29. The apparatus defined in claim 25 wherein the antenna cavity comprises a solderable metal coating, the apparatus further comprising solder with which the antenna resonating element is soldered to the solderable metal coating.

* * * * *

UNITED STATES PATENT AND TRADEMARK OFFICE

CERTIFICATE OF CORRECTION

PATENT NO. : 8,269,677 B2
APPLICATION NO. : 12/553943
DATED : September 18, 2012
INVENTOR(S) : Jerzy Guterman et al.

It is certified that error appears in the above-identified patent and that said Letters Patent is hereby corrected as shown below:

In the Claims

In claim 28, column 14, line 46, delete "reduce" and insert -- reduces --

Signed and Sealed this
Ninth Day of July, 2013

Teresa Stanek Rea
*Acting Director of the United States Patent and Trademark Office*